US009552691B2

(12) United States Patent
Nelson et al.

(10) Patent No.: US 9,552,691 B2
(45) Date of Patent: Jan. 24, 2017

(54) AUTOMATICALLY GENERATED DISPLAY CODE FOR WAGERING GAME MACHINE CONFIGURATION

(71) Applicant: WMS Gaming, Inc., Waukegan, IL (US)

(72) Inventors: Travis N. Nelson, Canton, GA (US); Peter R. Anderson, Glenview, IL (US); Sridhar Gondesi, Streamwood, IL (US); Jacek A. Grabiec, US, IL (US); Matthew J. Ward, Northbrook, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 219 days.

(21) Appl. No.: 14/282,564

(22) Filed: May 20, 2014

(65) Prior Publication Data

US 2014/0342820 A1 Nov. 20, 2014

Related U.S. Application Data

(60) Provisional application No. 61/825,416, filed on May 20, 2013.

(51) Int. Cl.
*G07F 17/32* (2006.01)

(52) U.S. Cl.
CPC ..... *G07F 17/3227* (2013.01); *G07F 17/3202* (2013.01); *G07F 17/3225* (2013.01); *G07F 17/3232* (2013.01); *G07F 17/3234* (2013.01); *G07F 17/3241* (2013.01)

(58) Field of Classification Search
CPC ..... G07F 17/3202; G07F 17/3227; G07F 17/3232; G07F 17/3234
See application file for complete search history.

(56) References Cited

U.S. PATENT DOCUMENTS

| | | | |
|---|---|---|---|
| 6,488,585 | B1 | 12/2002 | Wells et al. |
| 6,884,173 | B2 | 4/2005 | Gauselmann |
| 6,884,174 | B2 | 4/2005 | Lundy et al. |
| 6,939,234 | B2 | 9/2005 | Beatty |
| 7,326,116 | B2 | 2/2008 | O'Donovan et al. |
| 7,641,555 | B2 | 1/2010 | McKinley et al. |
| 7,707,507 | B1 | 4/2010 | Rowe et al. |

(Continued)

FOREIGN PATENT DOCUMENTS

| | | |
|---|---|---|
| EP | 2450825 | 3/2013 |
| EP | 2701099 | 2/2014 |

(Continued)

*Primary Examiner* — Dmitry Suhol
*Assistant Examiner* — David Duffy
(74) *Attorney, Agent, or Firm* — DeLizio Law, PLLC

(57) ABSTRACT

Systems, methods and machine-readable media operate on configuration data for wagering game machines. A wagering game machine configuration or meter data on a wagering game machine is modified. In response to the modification, the configuration data or meter data is transformed into a displayable code such as a bar code or QR (Quick Response) code. The wagering game machine presents the displayable code on a code display of the wagering game machine. A portable computing device reads the displayable code and uses the displayable code to compare the configuration data with configuration data obtained from other wagering game machines or configuration data obtained from a configuration server.

21 Claims, 5 Drawing Sheets

(56) References Cited

U.S. PATENT DOCUMENTS

| | | | | |
|---|---|---|---|---|
| 7,722,466 | B2 | 5/2010 | Rothschild | |
| 7,826,496 | B2 | 11/2010 | Gatto et al. | |
| 7,878,902 | B2 | 2/2011 | Mattice et al. | |
| 7,886,288 | B2 | 2/2011 | Breckner | |
| 7,887,420 | B2 | 2/2011 | Nguyen et al. | |
| 7,909,699 | B2 | 3/2011 | Parrott et al. | |
| 7,951,002 | B1 | 5/2011 | Brosnan | |
| 7,951,006 | B2 | 5/2011 | Wells et al. | |
| 8,043,160 | B2 | 10/2011 | Dasgupta | |
| 8,118,679 | B2 | 2/2012 | Gagner | |
| 8,122,512 | B2 | 2/2012 | Gatto et al. | |
| 8,167,703 | B2 | 5/2012 | Gagner et al. | |
| 8,172,686 | B2 | 5/2012 | Warkentin | |
| 8,185,890 | B2 | 5/2012 | Harris et al. | |
| 8,195,826 | B2 | 6/2012 | Ruppert et al. | |
| 8,231,471 | B2 | 7/2012 | Blackburn et al. | |
| 8,235,816 | B2 | 8/2012 | Nelson | |
| 2003/0013515 | A1* | 1/2003 | Rowe | G06Q 30/0209 463/25 |
| 2004/0002379 | A1* | 1/2004 | Parrott | G07F 17/32 463/29 |
| 2005/0197191 | A1* | 9/2005 | McKinley | G07F 17/3223 463/43 |
| 2005/0227771 | A1* | 10/2005 | Nelson | G07F 17/3267 463/43 |
| 2006/0025222 | A1* | 2/2006 | Sekine | G07F 17/32 463/42 |
| 2006/0046834 | A1* | 3/2006 | Sekine | G07F 17/32 463/20 |
| 2006/0063589 | A1* | 3/2006 | Chong | A63F 3/06 463/29 |
| 2007/0021215 | A1 | 1/2007 | Russell et al. | |
| 2007/0060302 | A1* | 3/2007 | Fabbri | G07F 17/323 463/24 |
| 2007/0060394 | A1 | 3/2007 | Gowin et al. | |
| 2007/0136817 | A1 | 6/2007 | Nguyen | |
| 2007/0153303 | A1* | 7/2007 | Abe | H04N 1/32144 358/1.8 |
| 2007/0218985 | A1* | 9/2007 | Okada | G07F 17/3267 463/30 |
| 2007/0218989 | A1* | 9/2007 | Okada | G07F 17/32 463/31 |
| 2008/0023546 | A1* | 1/2008 | Myodo | G06K 7/14 235/462.04 |
| 2008/0045346 | A1 | 2/2008 | Nelson et al. | |
| 2008/0051198 | A1 | 2/2008 | Nelson | |
| 2008/0102919 | A1 | 5/2008 | Rowe et al. | |
| 2008/0200256 | A1 | 8/2008 | Gagner et al. | |
| 2008/0207334 | A1 | 8/2008 | Swarna | |
| 2008/0268934 | A1* | 10/2008 | Mattice | G07F 17/32 463/16 |
| 2009/0149245 | A1* | 6/2009 | Fabbri | G07F 17/323 463/25 |
| 2009/0275401 | A1 | 11/2009 | Allen et al. | |
| 2009/0276715 | A1 | 11/2009 | Arbogast et al. | |
| 2010/0088497 | A1 | 4/2010 | Bunin | |
| 2010/0106823 | A1 | 4/2010 | Davis et al. | |
| 2010/0120486 | A1 | 5/2010 | DeWaal et al. | |
| 2010/0234097 | A1 | 9/2010 | Gelber et al. | |
| 2010/0255912 | A1 | 10/2010 | Ward et al. | |
| 2011/0092288 | A1 | 4/2011 | Pryzby et al. | |
| 2011/0115413 | A1 | 5/2011 | Erickson et al. | |
| 2011/0218038 | A1 | 9/2011 | Kinsley et al. | |
| 2011/0234829 | A1 | 9/2011 | Gagvani et al. | |
| 2011/0250953 | A1* | 10/2011 | Iyer | G07F 17/32 463/29 |
| 2011/0287828 | A1 | 11/2011 | Anderson et al. | |
| 2012/0021839 | A1* | 1/2012 | Brosnan | G07F 17/32 463/42 |
| 2012/0187187 | A1* | 7/2012 | Duff | G06Q 20/3276 235/382 |
| 2012/0208633 | A1 | 8/2012 | Salzman | |
| 2013/0017884 | A1* | 1/2013 | Price | G07F 17/32 463/25 |
| 2013/0137509 | A1* | 5/2013 | Weber | G07F 17/3202 463/29 |
| 2013/0137510 | A1* | 5/2013 | Weber | G07F 17/3227 463/29 |
| 2014/0053281 | A1 | 2/2014 | Benoit et al. | |

FOREIGN PATENT DOCUMENTS

| | | |
|---|---|---|
| WO | WO-2005071631 | 8/2005 |
| WO | WO-2006039132 | 4/2006 |
| WO | WO-2006119070 | 11/2006 |
| WO | WO-2007005992 | 1/2007 |
| WO | WO-2007012049 | 1/2007 |
| WO | WO-2007013970 | 2/2007 |

* cited by examiner

AUTOMATICALLY GENERATED DISPLAY CODE FOR WAGERING GAME MACHINE CONFIGURATION

RELATED APPLICATIONS

This application claims the priority benefit of U.S. Provisional Application Ser. No. 61/825,416 filed May 20, 2013.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

FIELD

Embodiments of the inventive subject matter relate generally to wagering game systems, and more particularly to automatically generating a display code that includes configuration information for the wagering game machine.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Configuration of a wagering game machine can have a significant impact on the ability for a wagering game machine to attract and support frequent play.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention, while the second section describes example wagering game machine architectures. The third section describes example operations performed by some embodiments. The fourth section presents some general comments.

Introduction

This section provides an introduction to some embodiments of the invention. In general, the embodiments include systems, methods and computer-readable media of varying scope in which configuration information about a wagering game machine is displayed in an encoded manner as a display code on a display of the wagering game machine. In some embodiments, the display code having the encoded configuration information is a QR (Quick Response) code. The display code may be updated in response to changes in the configuration of the wagering game machine, or in response to changes in meter data on the wagering game machine. The display code having the configuration information may be read by a portable device such as a tablet computer or other handheld device. The portable device may then compare the configuration information to a set of reference data, such as a configuration of another wagering game machine or with information held on a configuration server.

Wagering Game Machine Architectures

Figure 1:
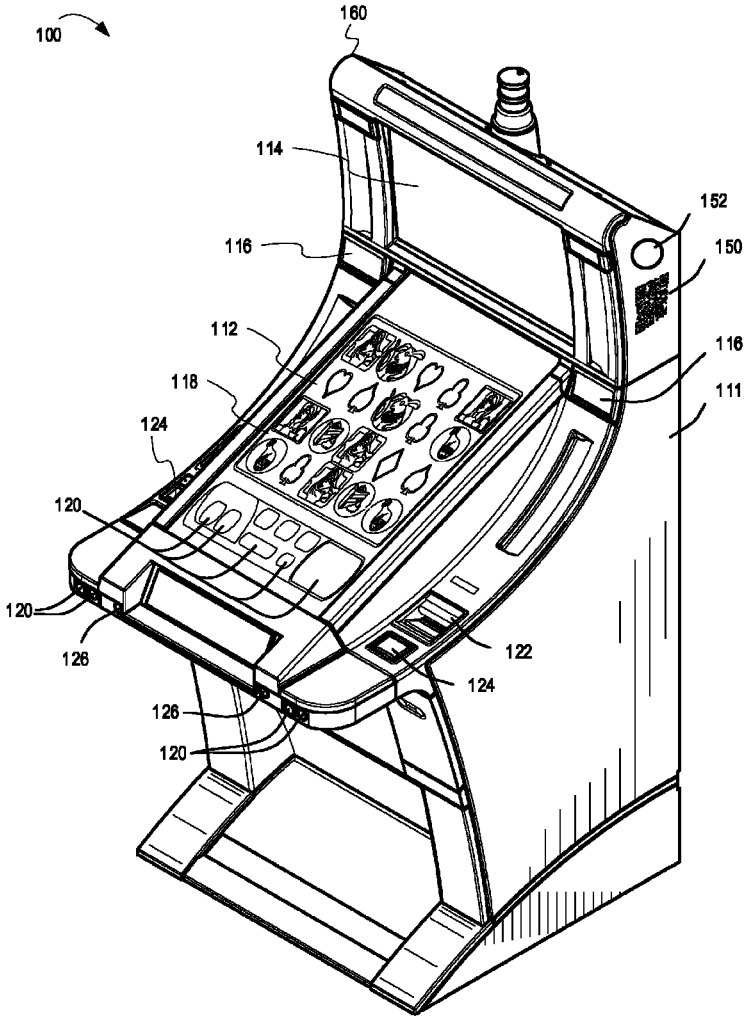
FIG. 1 is a perspective view of a wagering game machine, according to example embodiments of the invention.

FIG. 1 is a perspective view of a wagering game machine, according to example embodiments of the invention. Referring to FIG. 1, a wagering game machine 100 is used in gaming establishments, such as casinos. According to embodiments, the wagering game machine 100 can be any type of wagering game machine and can have varying structures and methods of operation. For example, the wagering game machine 100 can be an electromechanical wagering game machine configured to play mechanical slots, or it can be an electronic wagering game machine configured to play video casino games, such as blackjack, slots, keno, poker, blackjack, roulette, etc.

The wagering game machine 100 comprises a housing 112 and includes input devices, including value input devices 118 and a player input device 124. For output, the wagering game machine 100 includes a primary display 114 for displaying information about a basic wagering game. The primary display 114 can also display information about a bonus wagering game and a progressive wagering game. The wagering game machine 100 also includes a secondary display 116 for displaying wagering game events, wagering game outcomes, and/or signage information. While some components of the wagering game machine 100 are described herein, numerous other elements can exist and can be used in any number or combination to create varying forms of the wagering game machine 100.

The value input devices 118 can take any suitable form and can be located on the front of the housing 112. The value input devices 118 can receive currency and/or credits inserted by a player. The value input devices 118 can include coin acceptors for receiving coin currency and bill acceptors for receiving paper currency. Furthermore, the value input devices 118 can include ticket readers or barcode scanners for reading information stored on vouchers, cards, or other tangible portable storage devices. The vouchers or cards can authorize access to central accounts, which can transfer money to the wagering game machine 100.

The player input device 124 comprises a plurality of push buttons on a button panel 126 for operating the wagering game machine 100. In addition, or alternatively, the player input device 124 can comprise a touch screen 128 mounted over the primary display 114 and/or secondary display 116.

The various components of the wagering game machine 100 can be connected directly to, or contained within, the housing 112. Alternatively, some of the wagering game machine's components can be located outside of the housing 112, while being communicatively coupled with the wagering game machine 100 using any suitable wired or wireless communication technology.

The operation of the basic wagering game can be displayed to the player on the primary display 114. The primary display 114 can also display a bonus game associated with the basic wagering game. The primary display 114 can include a cathode ray tube (CRT), a high resolution liquid crystal display (LCD), a plasma display, light emitting diodes (LEDs), or any other type of display suitable for use in the wagering game machine 100. Alternatively, the primary display 114 can include a number of mechanical reels to display the outcome. In FIG. 1, the wagering game machine 100 is an "upright" version in which the primary display 114 is oriented vertically relative to the player. Alternatively, the wagering game machine can be a "slant-top" version in which the primary display 114 is slanted at about a thirty-degree angle toward the player of the wagering game machine 100. In yet another embodiment, the wagering game machine 100 can exhibit any suitable form factor, such as a free standing model, bartop model, mobile handheld model, or workstation console model.

A player begins playing a basic wagering game by making a wager via the value input device 118. The player can initiate play by using the player input device's buttons or touch screen 128. The basic game can include arranging a plurality of symbols along a payline 132, which indicates one or more outcomes of the basic game. Such outcomes can be randomly selected in response to player input. At least one of the outcomes, which can include any variation or combination of symbols, can trigger a bonus game.

In some embodiments, the wagering game machine 100 can also include an information reader 122, which can include a card reader, ticket reader, bar code scanner, RFID transceiver, or computer readable storage medium interface. In some embodiments, the information reader 122 can be used to award complimentary services, restore game assets, track player habits, etc.

Wagering game machine 100 includes a code display 150. Code display 150 is a variable electronic display unit that is capable of displaying coded information such as a QR (Quick Response) code, a bar code, or other image having encoded information. Code display 150 may be any type of display having sufficient size and resolution to display the desired encoded information. In some embodiments, code display 150 may be an LCD display. In alternative embodiments, code display 150 may be an electronic paper (e-paper) or electronic ink type of variable electronic display. Code display 150 may be powered using a power supply shared with other components of wagering game machine 100. Alternatively, code display 150 may have an independent power source such as a battery thereby providing the ability for code display 150 to maintain an image having encoded information even if the wagering game machine 100 is not connected to a power source or is in an unpowered state.

Although illustrated as a separate display in FIG. 1, code display 150 may be integrated with other components of wagering game machine 100. For example, code display 150 may be display on a button 124 or a display on player tracking device or other device on wagering game machine 100.

In some embodiments, wagering game machine 100 may include a camera 152 capable of capturing images.

In the embodiments represented by FIG. 1, code display 150 and camera 152 are shown on the side of wagering game machine 100. Those of skill in the art having the benefit of the disclosure will appreciate that code display 150 or camera 152 may be positioned in other locations on wagering game machine 100. In general, it is desirable to position code display 150 or camera 152 such that the code display 150 or camera 152 is accessible while a user is playing a game on wagering game machine 100, but does not interfere with game play.

Although FIG. 1 describes some embodiments, the following sections describe many other features and embodiments.

Figure 2:
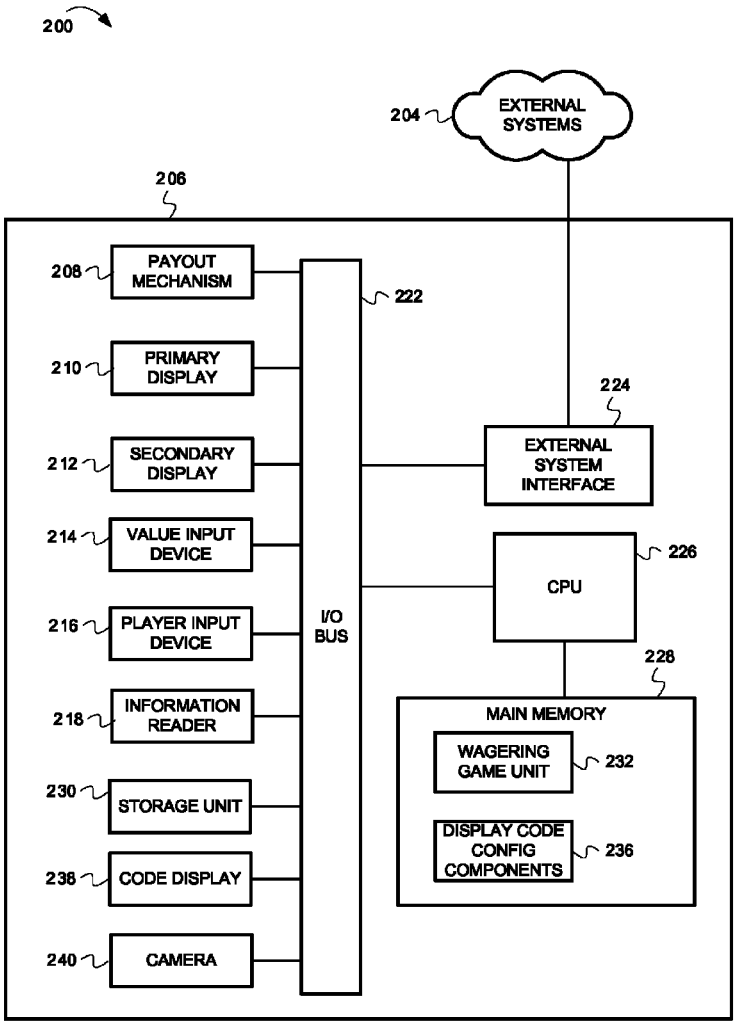
FIG. 2 is a block diagram illustrating a wagering game machine architecture, according to example embodiments of the invention

FIG. 2 is a block diagram illustrating a wagering game machine architecture 200, according to example embodiments of the invention. As shown in FIG. 2, the wagering game machine architecture 200 includes a wagering game machine 206, which includes a central processing unit (CPU) 226 connected to main memory 228. The CPU 226 can include any suitable processor, such as an Intel® Pentium processor, Intel® Core 2 Duo processor, AMD Opteron™ processor, or UltraSPARC processor. The main memory 228 includes a wagering game unit 232 and display code configuration components 236. In one embodiment, the wagering game unit 232 can present wagering games, such as video poker, video black jack, video slots, video lottery, etc., in whole or part. Display code configuration components 236 include data and functional units that provide and receiving configuration data for wagering game machine 206.

The CPU 226 is also connected to an input/output (I/O) bus 222, which can include any suitable bus technologies, such as an AGTL+ frontside bus and a PCI backside bus. The I/O bus 222 is connected to a payout mechanism 208, primary display 210, secondary display 212, value input device 214, player input device 216, information reader 218, and storage unit 230. The player input device 216 can include the value input device 214 to the extent the player input device 216 is used to place wagers. The I/O bus 222 is also connected to an external system interface 224, which is connected to external systems 204 (e.g., wagering game networks).

Code display 238 and camera 240 may be coupled directly to I/O bus 222 or indirectly, for example through a USB connection.

In one embodiment, the wagering game machine 206 can include additional peripheral devices and/or more than one of each component shown in FIG. 2. For example, in one embodiment, the wagering game machine 206 can include multiple external system interfaces 224 and/or multiple CPUs 226. In one embodiment, any of the components can be integrated or subdivided.

Any component of the architecture 200 can include hardware, firmware, and/or machine-readable media including instructions for performing the operations described herein. Machine-readable media includes any mechanism that provides (i.e., stores or transmits) information in a form readable by a machine (e.g., a wagering game machine, computer, etc.). For example, tangible machine-readable storage media includes read only memory (ROM), random access memory (RAM), magnetic disk storage media, optical storage media, flash memory machines, etc. capable of storing data and instructions. Machine-readable transmission media includes any media suitable for transmitting software over a network. For example, signals transmitted over a wired or wireless network are examples of machine-readable transmission media.

Figure 3:
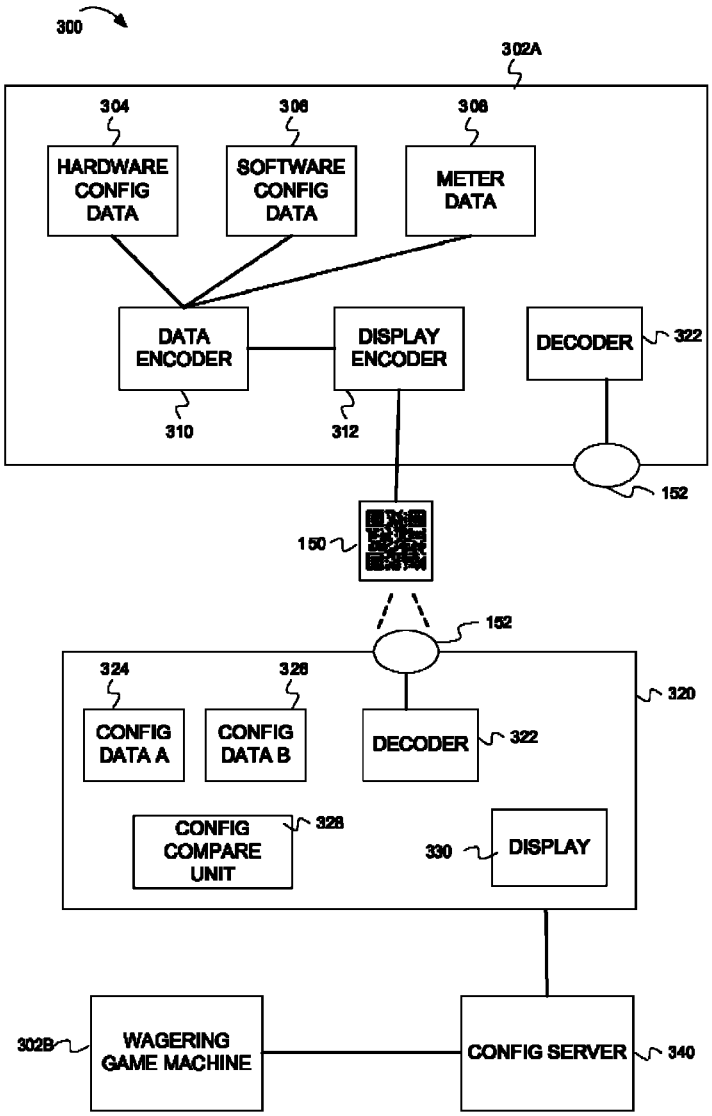
FIG. 3 is a block diagram illustrating components of a system using automatically generated display code for wagering game configuration according to embodiments.

FIG. 3 is a block diagram illustrating components of a system 300 using automatically generated display code for wagering game configuration according to embodiments. In some embodiments, system 300 includes a wagering game machine 302A and a portable computing device 320. System 300 may optionally include either or both a second wagering game machine 302B and a configuration server 340.

Wagering game machine 302A can be any type of wagering game machine configured to present a wagering game upon which monetary value may be wagered, and may include wagering game machine 100 (FIG. 1). Examples of such wagering games include video poker, video blackjack, video slots, video lottery, etc., the embodiments are not limited to any particular wagering game.

Wagering game machine 302A includes hardware configuration data 304, software configuration data 306, meter data 308, data encoder 310, display encoder 312 and configuration decoder 322. Wagering game machine 302B may include some or all of the aforementioned elements.

Hardware configuration data 304 includes data describing hardware components present on wagering game machine 302A. The data may include identifiers identifying a type, manufacturer, model etc. of hardware component (e.g., display, buttons, ticket reader etc.) and may also include data identifying a version of the hardware component.

Software configuration data 306 includes data describing software installed on wagering game machine 302A. As used herein, software may also include firmware. Such data may include identifiers identifying a software component, the maker of the software component, and a version of the software component.

Meter data 308 includes data regarding the credits currently available for wagering on wagering game machine 302A. Meter data may also include other data. For example, meter data 308 may include coin-in amounts, payout amounts etc. The embodiments are not limited to any particular type of meter data.

Data encoder 310 reads some or all of hardware configuration data 304, software configuration data 306 and meter data 308 and transforms the data into an encoded form. In some embodiments, data encoder 310 creates a signature using a signature algorithm on some or all of the data in hardware configuration data 304, software configuration data 306 and meter data 308. Examples of such signature algorithms are various versions of SHA (Secure Hash Algorithm), MAC (Message Authentication Code), and MD2. In some embodiments, data encoder 310 may encrypt the data instead of, or in addition to, creating a signature. Various encryption algorithms such as public/private key encryption may be used. The encoded data may be in binary form or it may be converted to text form.

Display encoder 312 receives the encoded data from data encoder 310 and creates a displayable code image suitable for display on code display 150. In some embodiments, display encoder 312 creates a bar code using the data received from data encoder 310. In alternative embodiments, display encoder 312 creates a QR code using the data received from data encoder 310. In some embodiments, display encoder 312 may read data directly from any or all of hardware configuration data 304, software configuration data 306 or meter data 308 rather than receiving data from data encoder 310 to create a displayable code using the data. The displayable code is then presented on code display 150.

In some embodiments, wagering game machine 302A includes camera 152. In such embodiments, decoder 322 may receive an image from camera 152 that includes a displayable code such as a QR code or bar code. Decoder 322 decodes the displayable code and may use the data resulting from the decoding to update software configuration data 306.

Portable computing device 320 may be any type of mobile computing device. Examples of such devices include tablet computers, mobile phones, laptop computers etc. The embodiments are not limited to any particular type of portable computing device. In some embodiments, portable computing device includes a camera 152, display 330, decoder 322 and a configuration comparison unit 328.

Camera 152 may be used to capture images. For example, in some embodiments, portable computing device 320 may be placed in proximity to code display 150 of wagering game machine 302A. Camera 152 may be used to capture an image displayed by code display 150 where the image includes a displayable code such as a QR code or bar code.

Decoder 322 receives the image data from camera 152 and decodes the displayable code in the image data to produce configuration data. As discussed above, the configuration data may be in the form of a signature representing configuration data from wagering game machine 302A. Alternatively, the configuration data may be the configuration data for wagering game machine 302A in a text or binary form. The configuration data may be stored on portable computing device 320. As an example, the configuration data for wagering game machine 302A may be stored as configuration data A 324.

In some embodiments, configuration data may be received via camera 152 and decoder 322 for a second wagering game machine, e.g., wagering game machine 302B. The configuration data for the second wagering game machine may be stored, for example, as configuration data B 326.

A configuration comparison unit 328 may compare configurations received from wagering game machines and stored on portable computing device 320. In some embodiments, configuration data from two or more wagering game machines 302 (e.g., configuration data A 324 and configuration data B 326) are compared. The results of the comparison may be presented on a display 330 of the portable computing device 320.

As a first example, portable computing device 320 may scan displayable codes presented on code displays 150 for a set of wagering game machines in a bank of wagering game machines. The configurations of such machines may be expected to be the same or similar. For example, assume that wagering game machines 302A and 302B are in a same bank of wagering game machines. The configuration comparison unit 328 may compare the configuration data (e.g., configuration data A 324 and configuration data B 326) to determine if the configuration data is the same on wagering game machines 302A and 302B. The results of the comparison may be presented on display 330, thereby alerting a user if there are discrepancies with respect to the configurations.

As a second example, portable computing device 320 may scan a displayable code presented on code display 150 of wagering game machine 302A. Portable computing device 320 may further obtain an expected configuration from a configuration server 340. Configuration comparison unit 328 may compare the expected configuration with the actual configuration data (e.g., configuration data A 324) and present the results of the comparison on display 330 of portable computing device 320. In embodiments where the configuration data A 324 is received in the form of a signature of configuration data on a wagering game machine, comparison unit 328 may transform the expected configuration by generating a signature for the expected configuration using the same signature algorithm that was used to generate the configuration data A 324. Comparison unit 328 may then compare the signatures to determine if the signatures are the same.

Figure 4:
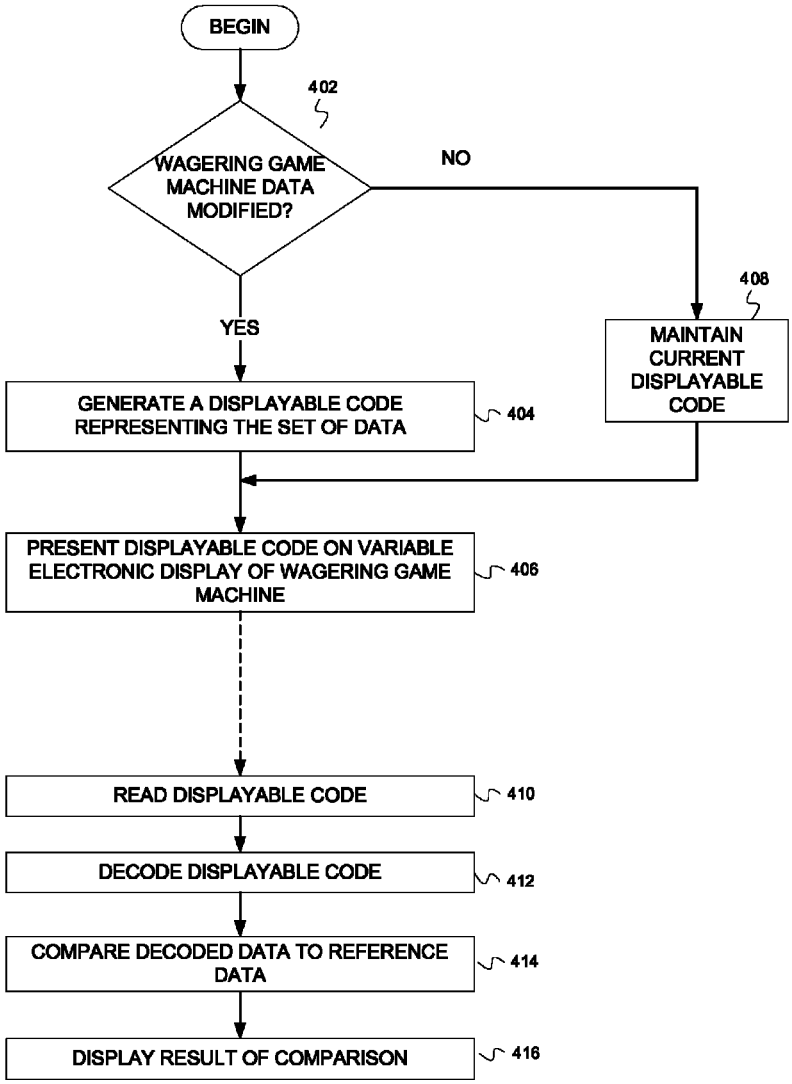
FIG. 4 is a flow diagram illustrating a method for verifying configurations of wagering game machines using displayable code according to embodiments.
Figure 5:
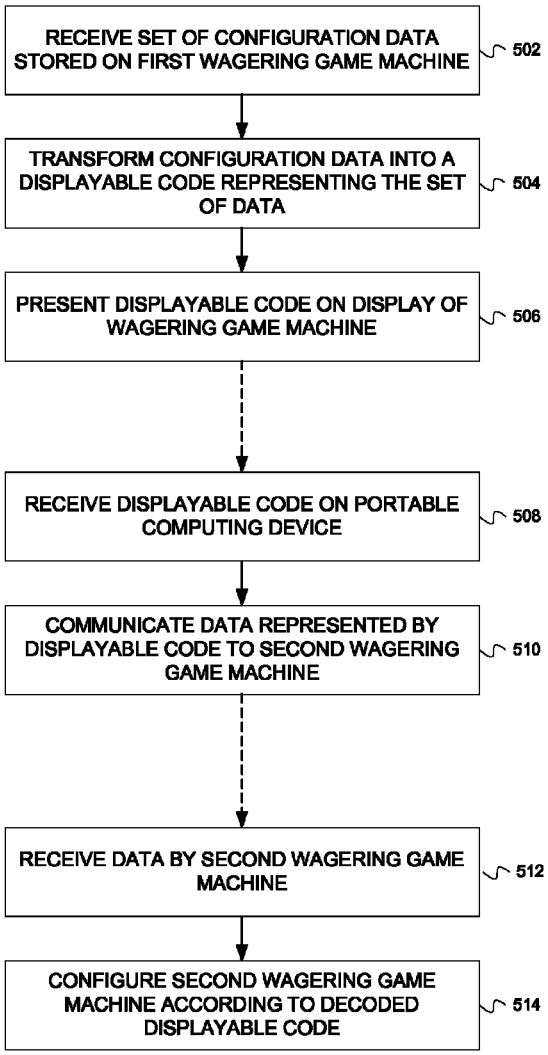
FIG. 5 is a flow diagram illustrating a method for configuring a wagering game machine using displayable code according to embodiments.

FIGS. 4-5 provide further details on the operation of the above-described system.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

The section will discuss FIGS. 4-5. The discussion of FIG. 4 will describe operations for performing comparing or verifying a configuration on wagering game machines. The discussion of FIG. 5 will describe operations for copying a configuration from one wagering game machine to another.

FIG. 4 is a flow diagram illustrating a method 400 for verifying configurations of wagering game machines using displayable code according to embodiments. Method 400 begins at block 402 with determining whether wagering game machine data has been modified. Various types of data may be checked for modification. In some embodiments, a wagering game machine checks hardware configuration data to determine if any hardware changes have occurred. For example, new hardware may be added, hardware may be replaced or removed, or hardware may become disabled or dysfunctional. The wagering game machine may also check to determine changes in software configuration data for the wagering game machine. For example, software may be added, updated, enabled, disabled or removed from a wagering game machine. Further, software parameters may be changed to enable or disable particular options. The wagering game machine may also determine that meter data has changed. For example, a credit meter value may change in response to wagering activity at the wagering game machine.

If the wagering game machine detects changes in hardware configuration, software configuration or meter data, then at block 404 the wagering game machine generates a displayable code from the configuration data. For example, the wagering game machine transforms some or all of the hardware configuration, software configuration or meter data into a displayable code representing the data. In some embodiments, the displayable code is a bar code. In alternative embodiments, the displayable code is a QR code.

Various other transformations may be performed prior to the transformation of the data into a displayable code. In some embodiments, the transformation may be organizing the data into a format compatible with the displayable code or in a format expected by a component that will later read the data. The transformation may include transforming binary data into a textual representation of the data. In alternative embodiments, some or all of the hardware configuration data, software configuration data or meter data may transformed into a signature representing the data. For example, an SHA, MAC (Message Authentication Code), or MD2 algorithm may be used to create a signature representing some or all of the hardware configuration data, software configuration data or meter data. In further alternative embodiments, the data may be encrypted. For example, the data may be encrypted using a public/private key encryption algorithm. Alternatively, the data may be encrypted using a shared private key.

The data included in the displayable code may depend on the quantity of data that the code is capable of including. For example, a bar code can contain less data than a QR code. Thus in embodiments using a bar code, a signature representing the configuration or meter data may be used. In embodiments using a QR code that can hold a larger quantity of data, the data may be a binary or text version of the actual configuration data rather than a signature. In still further embodiments, a combination of signatures and actual configuration data may be used. Further, the displayable code may be a reference to where the modified configuration data may be obtained. For example, the displayable code may be a URL (Uniform Resource Locator) identifying a network location where the modified configuration data resides.

Alternatively, if there has been no change in hardware configuration data, software configuration data or meter data, then at block 408 the current displayable code is maintained. That is, a previously generated displayable code representing the current configuration or meter data is used.

At block 406, the displayable code is presented in a display of a wagering game machine. In some embodiments, the displayable code is presented on a code display of the wagering game machine that is separate from displays used to present a wagering game or bonus game. In alternative embodiments, the displayable code is presented in a portion of a primary or secondary display of a wagering game machine.

It should be noted that blocks 402-408 may be executed while the wagering game machine is in a game playable state. That is, any of blocks 402-408 may be executed while the wagering game machine is ready to play a wagering game, while a user is playing a wagering game at the wagering game machine or while the wagering game machine is in an attract mode. Further, in embodiments where the code display has an independent power source (e.g., a battery), the displayable code may be presented on the code display of the wagering game machine even if the wagering game machine is not currently in a powered state.

Further, it should be noted that in some embodiments, meter data may change far more frequently than configuration data such as hardware configuration data, firmware configuration data or software configuration data. Thus in some embodiments, blocks 402-408 may be executed in response to detecting changes in configuration data, while changes in meter data do not result in regenerating the displayable code.

At block 410, a portable computing device such as a laptop computer, tablet computer, mobile phone or other handheld device reads image data for the displayable code presented at block 406 using a camera or other image sensing device on the portable computing device.

At block 412, the portable computing device decodes the displayable code. For example, the portable computing device decodes a bar code or QR code. In addition, the portable computing device may do further processing of the data in the bar code or QR code. For example, the portable computing device may decrypt the data using a public or private key.

At block 414, the portable computing device compares the decoded data to a set of reference data. The set of reference data may come from any of a variety of sources. In some embodiments, the set of reference data may be configuration data for a second wagering game machine (e.g., data read from a code display on a second wagering game machine). For example, the second wagering game machine may be a wagering game machine in a same bank of wagering game machines as the current wagering game machine. In alternative embodiments, the set of reference data may be configuration data for an expected configuration of the wagering game machine. For example, the portable computing device may obtain an expected configuration from a configuration server.

At block 416, the results of the comparison are presented on a display of the portable computing device. The results displayed will depend on the data coded into the displayable code. For example, in cases where the displayable code contains a signature representing hardware configuration, software configuration, or meter data, the results of the comparison will typically be an indication of whether or not the configuration data obtained from the wagering game machine via the code display is the same as the set of reference data or different from the reference data. In cases where the displayable code contains the actual configuration data (perhaps in an encrypted form), the results of the comparison may include data that indicates not only whether or not the configuration data and the set of reference data are the same, but also may include data that indicates the configuration elements that are different and the differing values.

The following example will be used to illustrate operation of the above-described method. Assume that the wagering game machine has determined the following signatures for configuration data associated with firmware, operating system and game software:

Firmware: 74b5b5e9570efc5c0553bb327cd41940

OS: 17c10091293fdc562a6 db69940ee924

Game: 63d72051e901c069f8aalb32aa0c43bb

The tags (e.g., "Firmware", "OS", "Game") and associated signatures above may be included as data in a bar code or QR code presented on a code display for the wagering game machine. Alternatively, the signatures may be ordered (e.g., alphabetically) and concatenated to produce a concatenated signature string:

17bc10091293fdc562a6
db69940ee92463d72051e901c069f 8aalb32a
a0c43bb74b5b5e9570efc5c0553bb327cd41940

The concatenated signature string may be transformed using a hashing algorithm to obtain the output, for example "26d7a5fa493e163bafbfcf395d97f62", which may transformed into a displayable code be presented on a code display of the wagering game machine.

It should be noted that the method illustrated in FIG. 4 may take place at various stages of a wagering game machine's production and deployment. For example, configuration data may be verified while the wagering game machine is being manufactured or transported. Further, configuration data may be verified after the wagering game machine has been placed into operation at a casino. Additionally, the configuration data may be presented on the display while the wagering game machine is in a playable state, for example, while a user is playing a wagering game at the wagering game machine.

FIG. 5 is a flow diagram illustrating a method 500 for configuring a wagering game machine using displayable code according to embodiments. The method begins at block 502 with receiving a set of configuration data for a first wagering game machine. The configuration data can be data describing configuration options for an operating system, firmware, or wagering game software for the first wagering game machine.

At block 504, the configuration data is transformed into a displayable code representing the set of configuration data received at block 502. For example, the configuration data may be transformed into a QR code. However, the embodiments are not limited to QR codes. Any displayable code that has a capacity to store a suitable quantity of configuration data may be used. In some embodiments, the data may be encrypted prior to transforming the data into a displayable code.

At block 506, the displayable code is presented on the wagering game machine. In some embodiments, a QR code is presented on a code display of the first wagering game machine.

At block 508, a portable computing device such as tablet computer, mobile phone, or laptop computer reads the displayable code from the first wagering game machine via a camera or other image capture device on the portable computing device. The portable computing device may interpret the displayable code and if necessary, decrypts the data using a public key, private key, or shared key.

At block 510, the data obtained from the displayable code is communicated to a second wagering game machine. In some embodiments, the data may be communicated by presenting a displayable code on a display of the portable computing device. For example, the portable computing device may display a copy of a QR code received from the first wagering game machine on a display of the portable computing device. In alternative embodiments, the data obtained from the displayable code is communicated to the second wagering game machine using a near field communication device. In further alternative embodiments, the data may be communicated wirelessly, for example, using a Bluetooth protocol or WiFi protocol. In still further embodiments, the portable computing device may be coupled to the second wagering game machine, for example, using a USB connection.

At block 512, the second wagering game machine receives the data communicated by the portable computing device. For example, the second wagering game machine may receive a QR code or other displayable code via a camera or other image capture device on the second wagering game machine. Alternatively, the second wagering game machine may receive the configuration data via a NFC device, Bluetooth device, wireless device or USB connection.

At block 514, the second wagering game machine updates its configuration based on the data received at block 512.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method comprising:

storing configuration data in one or more memory devices of a first wagering game machine, the configuration data representing a configuration of the first wagering game machine, wherein the first wagering game machine comprises an input device configured to:

detect a physical item associated with monetary value that establishes a credit balance, and receive a cashout input that initiates a payout from the credit balance, wherein the credit balance changes based on play of the first wagering game machine;

generating, by at least one of one or more processors, a displayable code from the configuration data;

presenting the displayable code on a variable electronic display of the first wagering game machine;

wherein the displayable code can be captured by a portable computing device configured to:

decode the displayable code to produce decoded data;

compare the decoded data to data representing configuration data obtained from a second wagering game machine; and display the result of comparing the decoded data on the portable computing device, wherein the results includes an indication of a configuration element in the configuration data that is different from the decoded data.

2. The computer-implemented method of claim 1, further comprising:

determining whether the configuration data stored on the first wagering game machine has been modified; and in response to determining that the configuration data has been modified, generating a second displayable code from the modified configuration data and presenting the second displayable code on the variable electronic display.

3. The computer-implemented method of claim 1, wherein storing the configuration data includes storing one or more of hardware configuration data, firmware configuration data or software configuration data.

4. The computer-implemented method of claim 1, further comprising generating a signature for the configuration data and wherein generating the displayable code includes generating displayable code from the signature.

5. The computer-implemented method of claim 1, wherein generating the displayable code includes generating a QR (Quick Response) code from the configuration data.

6. The computer-implemented method of claim 1, wherein presenting the displayable code on the variable electronic display of the first wagering game machine includes presenting the displayable code while the first wagering game machine is in a game playable state.

7. The computer-implemented method of claim 1, further comprising encrypting the configuration data.

8. A system comprising:

a first wagering game machine comprising:

one or more processors, an input device configured to:

detect a physical item associated with monetary value that establishes a credit balance, and receive a cashout input that initiates a payout from the credit balance, wherein the credit balance changes based on play of the first wagering game machine;

a variable electronic display, and one or more memory devices storing configuration data representing a configuration of the first wagering game machine, and storing machine instructions, that when executed by the one or more processors, cause the first wagering game machine to generate a displayable code from the configuration data and present the displayable code on the variable electronic display wherein the displayable code can be captured by an image capture device; and a portable computing device configured to:

read the displayable code from the variable electronic display of the first wagering game machine, decode the displayable code to produce decoded data, compare the decoded data to data representing configuration data obtained from a second wagering game machine, and present a result of comparing the decoded data on an electronic display of the portable computing device, wherein the result includes an indication of a configuration element in the configuration data that is different from the decoded data.

9. The system of claim 8, wherein the machine instructions further include instructions to cause the first wagering game machine to:

determine whether the configuration data stored on the first wagering game machine has been modified; and in response to a determination that the configuration data has been modified, generate a second displayable code from the modified configuration data and present the second displayable code on the variable electronic display.

10. The system of claim 8, wherein the variable electronic display comprises a LCD (Liquid Crystal Display) separate from a primary display and a secondary display of the first wagering game machine.

11. The system of claim 8, wherein the variable electronic display is coupled to a first power supply independent from a second power supply for the first wagering game machine.

12. The system of claim 8, wherein the configuration data includes one or more of hardware configuration data, firmware configuration data or software configuration data.

13. The system of claim 8, wherein the machine instructions further include machine instructions to generate a signature from the configuration data and wherein the displayable code includes displayable code representing the signature.

14. The system of claim 8, wherein the displayable code comprises a QR code.

15. The system of claim 8, wherein the one or more memory devices further store instructions, that when executed by the one or more processors, cause the first wagering game machine to encrypt the data representing the configuration.

16. One or more machine-readable storage media having stored thereon instructions, that when executed, cause one or more processors to perform operations comprising:

storing configuration data in one or more memory devices of a first wagering game machine, the configuration data representing a configuration of the first wagering game machine, wherein the first wagering game machine comprises an input device configured to:

detect a physical item associated with monetary value that establishes a credit balance, and receive a cashout input that initiates a payout from the credit balance, wherein the credit balance changes based on play of the first wagering game machine;

generating a displayable code from the configuration data; and presenting the displayable code on a variable electronic display of the first wagering game machine;

reading the displayable code by a portable computing device;

decoding the displayable code by the portable computing device to produce decoded data;

comparing the decoded data to data representing configuration data obtained from a second wagering game machine; and displaying a result of comparing the decoded data on the portable computing device wherein the result includes an indication of a configuration element in the configuration data that is different from the decoded data.

17. The one or more machine-readable storage media of claim 16, wherein the operations further comprise:

determining whether the configuration data stored on the first wagering game machine has been modified; and in response to determining that the configuration data has been modified, generating a second displayable code from the modified configuration data and presenting the second displayable code on the variable electronic display.

18. The one or more machine-readable storage media of claim 16, wherein storing the configuration data includes storing one or more of hardware configuration data, firmware configuration data or software configuration data.

19. The one or more machine-readable storage media of claim 16, wherein the operations further comprise generating a signature for the configuration data and wherein generating the displayable code includes generating displayable code from the signature.

20. The one or more machine-readable storage media of claim 16, wherein generating the displayable code includes generating a QR (Quick Response) code from the configuration data.

21. The one or more machine-readable storage media of claim 16, wherein the operations further comprise encrypting the configuration data.

* * * * *